US005617829A

United States Patent [19]

Bidner et al.

[11] Patent Number: 5,617,829

[45] Date of Patent: Apr. 8, 1997

[54] METHOD FOR MAINTAINING CLEAN SPARK PLUGS IN A VARIABLE DISPLACEMENT ENGINE

[75] Inventors: David K. Bidner, Livonia; Glenn A. Zimlich, Dearborn Heights; Daniel V. Orzel, Westland, all of Mich.

[73] Assignee: Ford Motor Company, Dearborn, Mich.

[21] Appl. No.: 560,560

[22] Filed: Nov. 20, 1995

[51] Int. Cl.[6] ..... F02D 43/00

[52] U.S. Cl. ..... 123/481

[58] Field of Search ..... 123/481, 198 F, 123/334, 335

[56] References Cited

U.S. PATENT DOCUMENTS

| | | | |
|---|---|---|---|
| 2,875,742 | 3/1959 | Dolza | 123/481 |
| 4,470,390 | 9/1984 | Omori et al. | 123/335 |
| 4,550,704 | 11/1985 | Barho et al. | 123/481 |
| 4,947,810 | 8/1990 | Gillbrand et al. | 123/179.5 |
| 4,976,228 | 12/1990 | Kawamura | 123/198 F |
| 5,099,816 | 3/1992 | Ohga et al. | 123/481 |
| 5,117,792 | 6/1992 | Kanno | 123/335 |
| 5,377,631 | 1/1995 | Schechter | 123/198 F |

FOREIGN PATENT DOCUMENTS 6-108958 4/1994 Japan .

OTHER PUBLICATIONS

Patent Abstracts of Japan, vol. 18, No. 389, [M1642], Jul. 21, 1994 & JP 6–108958 (Ishii, et al), Apr. 19, 1994.

*Primary Examiner*—Andrew M. Dolinar
*Attorney, Agent, or Firm*—Jerome R. Drouillard; Roger L. May

[57] ABSTRACT

A method for maintaining clean spark plugs in a variable displacement engine in which at least one group of cylinders is disabled in response to the engine load being less than a predetermined value. A first timer determines the maximum period that the engine may be operated with the first group of cylinders being disabled. A second timer controls the period of time the previously deactivated cylinders need to be reactivated to clean the spark plugs, after being deactivated for the maximum period of time.

17 Claims, 5 Drawing Sheets

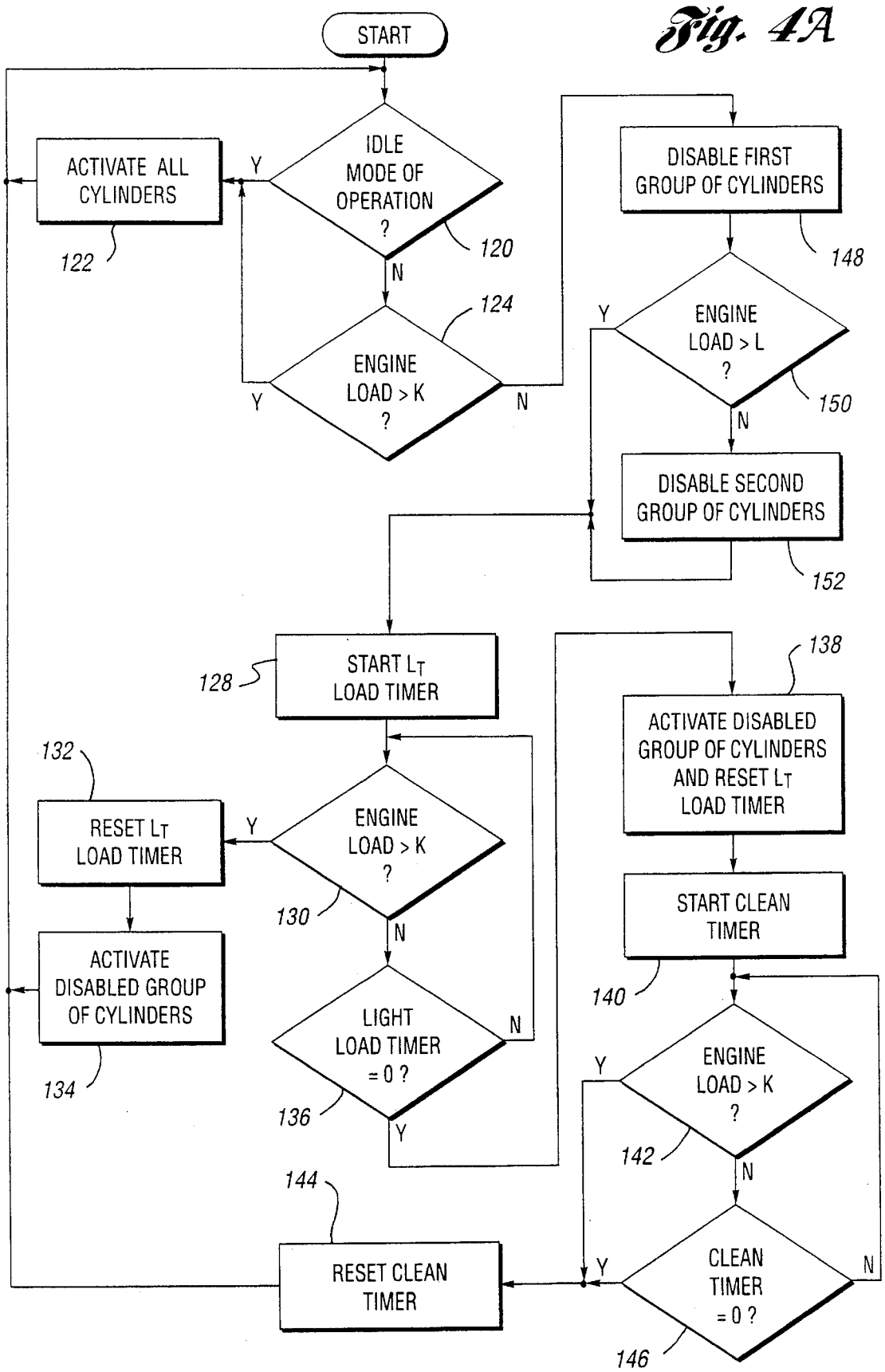
Fig. 4A
START
IDLE MODE OF OPERATION ?
120
Y
N
ACTIVATE ALL CYLINDERS
122
ENGINE LOAD > K ?
124
Y
N
DISABLE FIRST GROUP OF CYLINDERS
148
ENGINE LOAD > L ?
150
Y
N
DISABLE SECOND GROUP OF CYLINDERS
152
START LT LOAD TIMER
128
ENGINE LOAD > K ?
130
Y
N
RESET LT LOAD TIMER
132
ACTIVATE DISABLED GROUP OF CYLINDERS
134
LIGHT LOAD TIMER = 0 ?
136
N
Y
ACTIVATE DISABLED GROUP OF CYLINDERS AND RESET LT LOAD TIMER
138
START CLEAN TIMER
140
ENGINE LOAD > K ?
142
Y
N
CLEAN TIMER = 0 ?
146
Y
N
RESET CLEAN TIMER
144

METHOD FOR MAINTAINING CLEAN SPARK PLUGS IN A VARIABLE DISPLACEMENT ENGINE

TECHNICAL FIELD

The invention is related to the field of spark plugs for internal combustion engines and, in particular, to a method for maintaining clean spark plugs in a variable displacement engine.

BACKGROUND ART

Variable displacement engines are currently being developed to provide more efficient operation of automotive vehicles. Such a variable displacement engine is taught by Dolza in U.S. Pat. No. 2,875,742, and Barho et al. in U.S. Pat. No. 4,550,704.

One of the major problems encountered in variable displacement engines is that the spark plugs in the deactivated cylinders of the variable displacement engines tend to foul for various reasons. To prevent the spark plugs from fouling, Dolza teaches periodic alternating of the cylinder groups which are activated and deactivated at relatively frequent intervals while Barho et al. teaches alternating the cylinder groups which are activated based on the number of revolutions of the engine. Alternatively, Schechter, in U.S. Pat. No. 5,377,631, uses a skip cycle strategy in which a selected cylinder or cylinders are deactivated during a single cycle and a different cylinder or cylinders are deactivated in subsequent engine cycles.

As is recognized in the field of variable displacement engines, the fouling of the spark plugs in the deactivated cylinders is one of the major problems.

The prior art also teaches that the energizing of the spark plugs in the deactivated cylinders tends to enhance or increase the rate at which spark plugs will foul.

DISCLOSURE OF THE INVENTION

The object of the invention is a method for maintaining clean spark plugs in a variable displacement engine.

Another object of the invention is to reactivate previously deactivated cylinders after a predetermined period of time to keep the spark plugs clean.

Still another object of the invention is to reactivate the previously deactivated cylinders for a period of time selected to clean the spark plugs.

Yet another object of the invention is to operate the variable displacement engine at a reduced displacement for an extended period of time, up to 30 minutes, during prolonged light load conditions such as expressway or freeway driving using cruise control.

In accordance with the invention, the method comprises generating an engine load signal in response to the operating conditions of-the engine, then generating a light load signal when the engine load is less than a predetermined value. A first group of cylinders is disabled in response to the light load signal to reduce the displacement of the engine and improve the engine economy. The method further consists of detecting when the first group of cylinders have been disabled for a first period of time ranging from 15 to 30 minutes, to re-activate the previously deactivated cylinders for a second period of time sufficient to clean the spark plugs.

The disabling of the cylinders in the first group terminates the fuel delivery to each disabled cylinder and inhibits the spark plug from generating a spark.

The period of time which the cylinders are re-enabled is the time for the engine to make a preselected number of revolutions, preferably in the range from 20 to 30 revolutions.

These and other objects of the invention may be more apparent from a reading of the specification in conjunction with the drawings.

BRIEF DESCRIPTION OF THE DRAWINGS

FIG. 4A is an alternate embodiment of the flow diagram shown in FIG. 4.

BEST MODE FOR CARRYING OUT THE INVENTION

Figure 1:
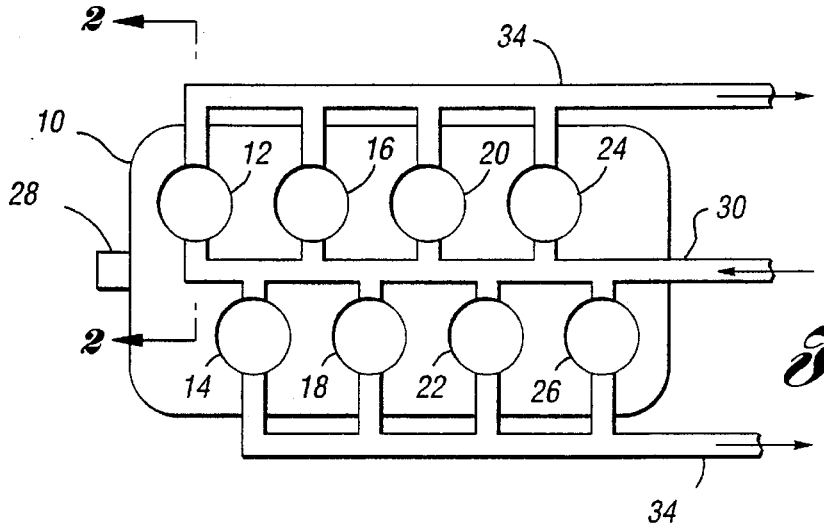
FIG. 1 is a top view of a variable displacement engine according to the invention.

The invention is directed to maintaining clean spark plugs in a variable displacement engine 10 as shown in FIG. 1. The engine 10, in the given example, has 8 cylinders, cylinders 12 through 26 connected to a common crankshaft 28. Although in the example shown, the variable displacement engine has 8 cylinders, the engine 10 may have 12, 10, 6 or 4 cylinders as is known in the art. The cylinders 12 through 26 are adapted to be fired in any suitable order to rotate the crankshaft.

Figure 2:
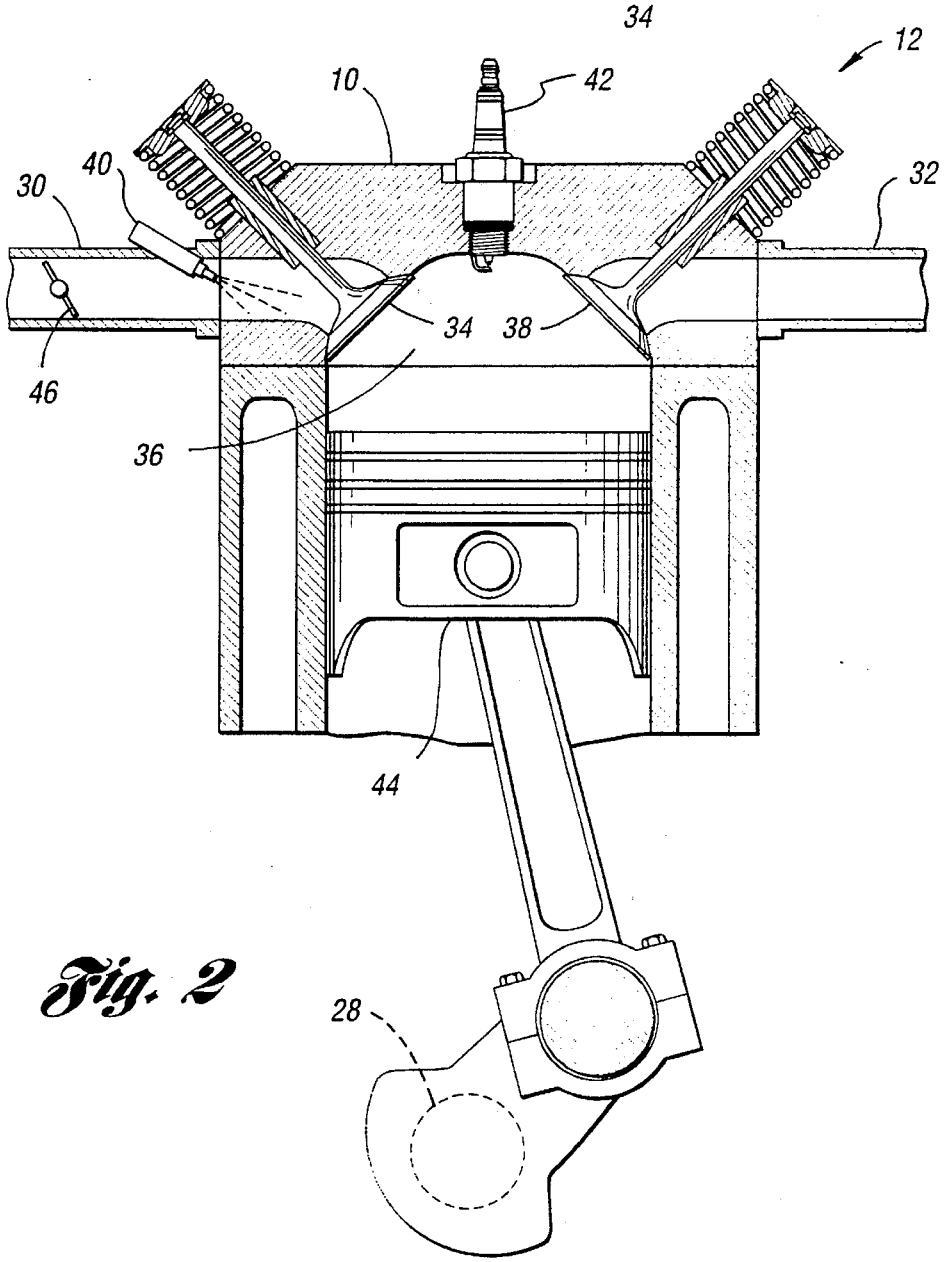
FIG. 2 is a partial cross-sectional view of the variable displacement engine shown in FIG. 1 along sectional line 2—2.

Each cylinder is connected to an air intake manifold 30 and an exhaust manifold 32. As shown more clearly in FIG. 2, each cylinder has an intake valve 34 disposed between the air intake manifold 30 and the combustion chamber 36 and an exhaust valve 38 disposed between the combustion chamber 36 and the exhaust manifold 32 in a conventional manner. The opening and closing of the intake valve 34 and the exhaust valve 38 are controlled as a function of the rotational position of the crankshaft 28 as is known in the art.

Means, such as a fuel injector 40, is disposed upstream of the intake valve 34 to provide a predetermined quantity of fuel to the air being ingested into the combustion chamber 36 through the intake valve 34 to form a combustible air/fuel mixture. A spark plug 42 produces an electrical spark in the combustion chamber 36 in timed sequence with the rotation of the crankshaft 28 and the position of the piston 44 to ignite the combustible air/fuel mixture. The combustion of the air/fuel mixture in the combustion chamber 36 displaces the piston 44 to rotate the crankshaft 28. A throttle valve 46 disposed in the air intake manifold 30 controls the quantity of air being inhaled into the engine.

In variable displacement engines taught by the prior art, the cylinders are divided into groups of cylinders which may be activated or deactivated as a function of engine load such as the quantity of air being supplied to the engine and the engine's rotational speed. For example, Dolza in U.S. Pat. No. 2,875,742 and Barho et al. in U.S. Pat. No. 4,550,704, teach the disablement of a group of cylinders by terminating fuel delivery to the deactivated cylinders. The intake and exhaust valves of the deactivated cylinders are opened and closed with the rotation of the crankshaft causing the deactivated cylinders to function as air pumps. In other types of variable displacement engines, such as taught by Schechter in U.S. Pat. No. 5,377,631, the individual control of the intake and exhaust valves to provide unthrottled operation to avoid engine pumping losses. Schechter also teaches disabling the spark to the disabled cylinder or cylinders. All of these systems teach alternating which cylinders are disabled on a relatively frequent basis to prevent fouling of the spark plugs in the disabled cylinders.

Figure 3:
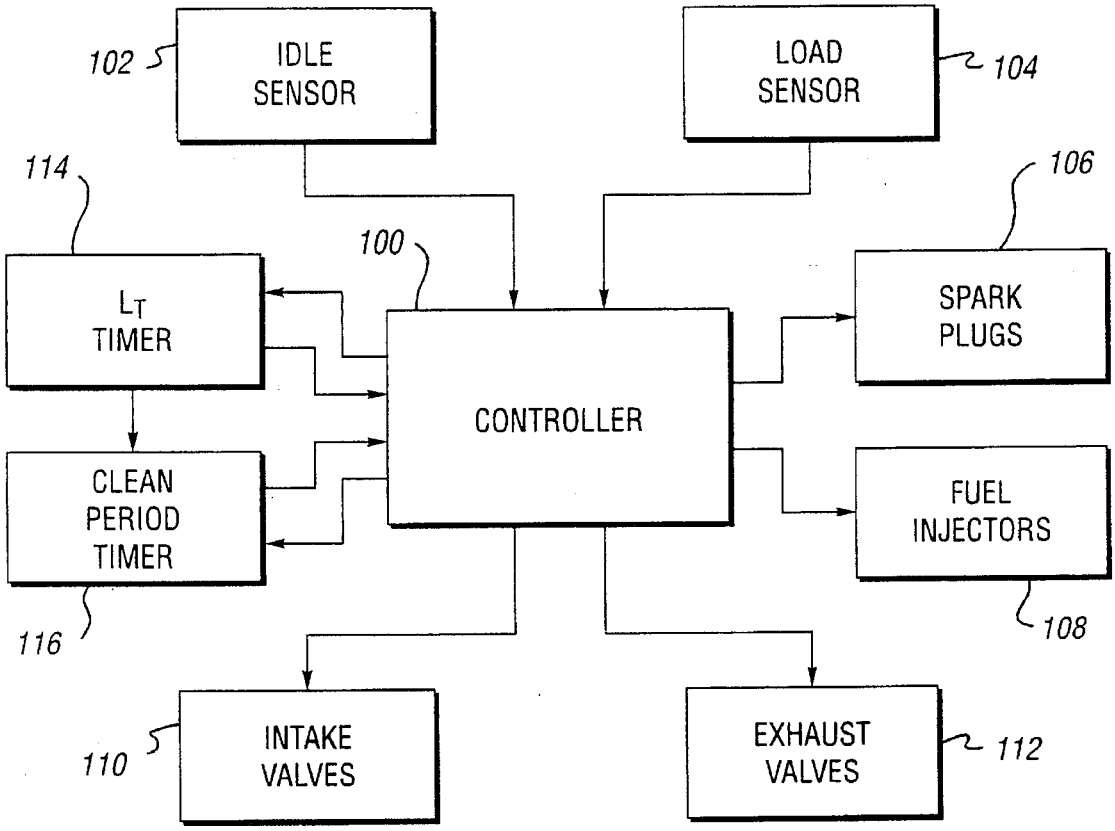
FIG. 3 is a block diagram of the control for maintaining clean spark plugs according to the invention.

The control system for maintaining clean spark plugs in a variable displacement engine according to the invention is shown in FIG. 3. A controller 100 receives inputs from an idle sensor 102 and an engine load sensor 104. The idle sensor 102 may be a switch activated by the throttle plate 46 of the engine when the throttle plate 46 is in the idle position. The engine load sensor 104 may be of any kind of load sensor known in the art and may consist of a mass air flow sensor and an engine speed sensor as is commonly used by the electronic engine fuel control systems for computing the quantity of fuel to be delivered to each engine cylinder.

The operation of the controller 100 is to assure activation of all of the engine cylinders when the engine is in the idle mode of operation. This assures that the variable displacement engine will idle smoothly without stalling. The other function of the controller 100 is to disable a predetermined group or sets of cylinders when the engine load is below a predetermined value, K. In the deactivation of the cylinders, the controller will terminate the energization of the spark plugs associated with the group of cylinders to be deactivated and also will inhibit the fuel delivery to the deactivated or disabled cylinder by fuel injectors 40. Preferably, the controller will also control the operation of the intake valves 110 and the exhaust valves 112 of the disabled cylinders to provide unthrottled operation and reduce pumping losses.

The time the disabled cylinders remain disabled when the engine load is below the predetermined value is controlled by a light load timer as shall be explained relative to the flow diagram shown in FIG. 4. If the light load timer expires (times-out), prior to engine load having a value greater than the predetermined value, the controller 100 will re-enable the disabled cylinders for a period of time, determined by the clean period timer 116 selected to clean the spark plugs of the carbon and sludge collected on the spark plugs during the period the cylinders were disabled.

Figure 4:
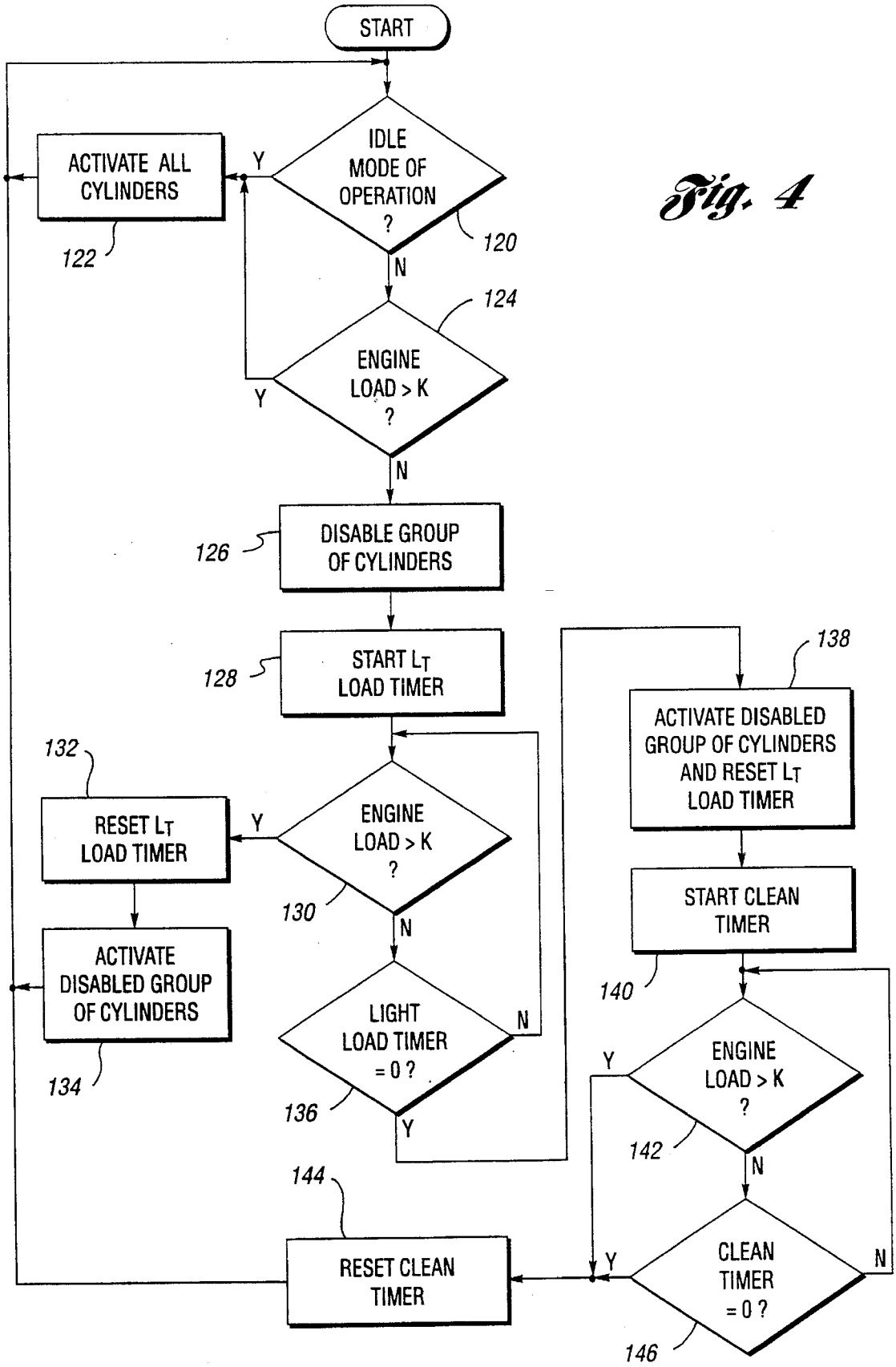
FIG. 4 is a flow diagram of the method for maintaining clean spark plugs according to the invention.

Turning now to the flow diagram shown in FIG. 4, the controller first inquires decision block 120 if the engine is in the idle mode of operation indicated by the signal generated by the idle sensor 102. If the engine is in the idle mode of operation, all of the cylinders are activated as indicated by block 122, the method then cycles back to decision block 120. This cycle is repeated until the idle sensor signifies the idle mode of operation is terminated.

Upon termination of the idle mode of operation, the controller 100 will inquire, decision block 124 of the engine load is greater than the predetermined value, K. When the engine load is greater than the value K, all of the cylinders remain activated as indicated by block 122. Otherwise, the controller 100 will disable a group of cylinders, block 126, and start the light load timer 114 as indicated by block 128. In the preferred embodiment, the controller may disable half of the cylinders, however, the controller may disable a fewer number of cylinders and may disable different groups of cylinders as a function of the engine load as shown in FIG. 4A. For example, the controller 100 may disable a first group of cylinders, block 148, when the engine load is less than a first predetermined value K, decision block 124 then disable a second group of cylinders block 152 in addition to the first group of cylinders when the engine load is less than a second predetermined value L lower than the first predetermined value as indicated by decision block 50.

After the light load timer is started, the controller 100 will repetitively inquire, decision block 130 if the engine load is still below the value K. When it is, the controller will inquire, decision block 132, if the light load timer has expired, i.e., light load time=0. If so, the controller will reactivate the disabled group of cylinders and reset the light load timer 114 as indicated by blocks 138 and 140, respectively. However, if the engine load signal has a value greater than the predetermined value K, the controller will reset the light load timer 114 and reactivate the disabled cylinders as indicated by blocks 132 and 134, respectively.

When the engine load remains less than the predetermined value K and the light load timer 114 has not timed out, the process will cycle back to decision block 130 until the engine load exceeds the predetermined value K or the light load timer 114 times out. After the light load timer 114 times out, the disabled cylinders are reactivated, the light load timer is reset, and the clean period timer is started. The controller will again inquire, decision blocks 142, if the engine load exceeds the predetermined value K and, if so, will reset the clean period timer 116 as indicated by block 144 then return to decision block 124 and the process is repeated. However, if the engine load remains less than the predetermined value, the controller will inquire, decision block 146, if the clean period timer has timed out. If not, the controller 100 will again inquire if the load signal is less than K. This process will be repeated until either the engine load signal exceeds the value K or the clean period timer times out. When the latter happens, the clean period timer 116 will be reset block 144, and the controller will return to decision block 120.

Figure 3A:
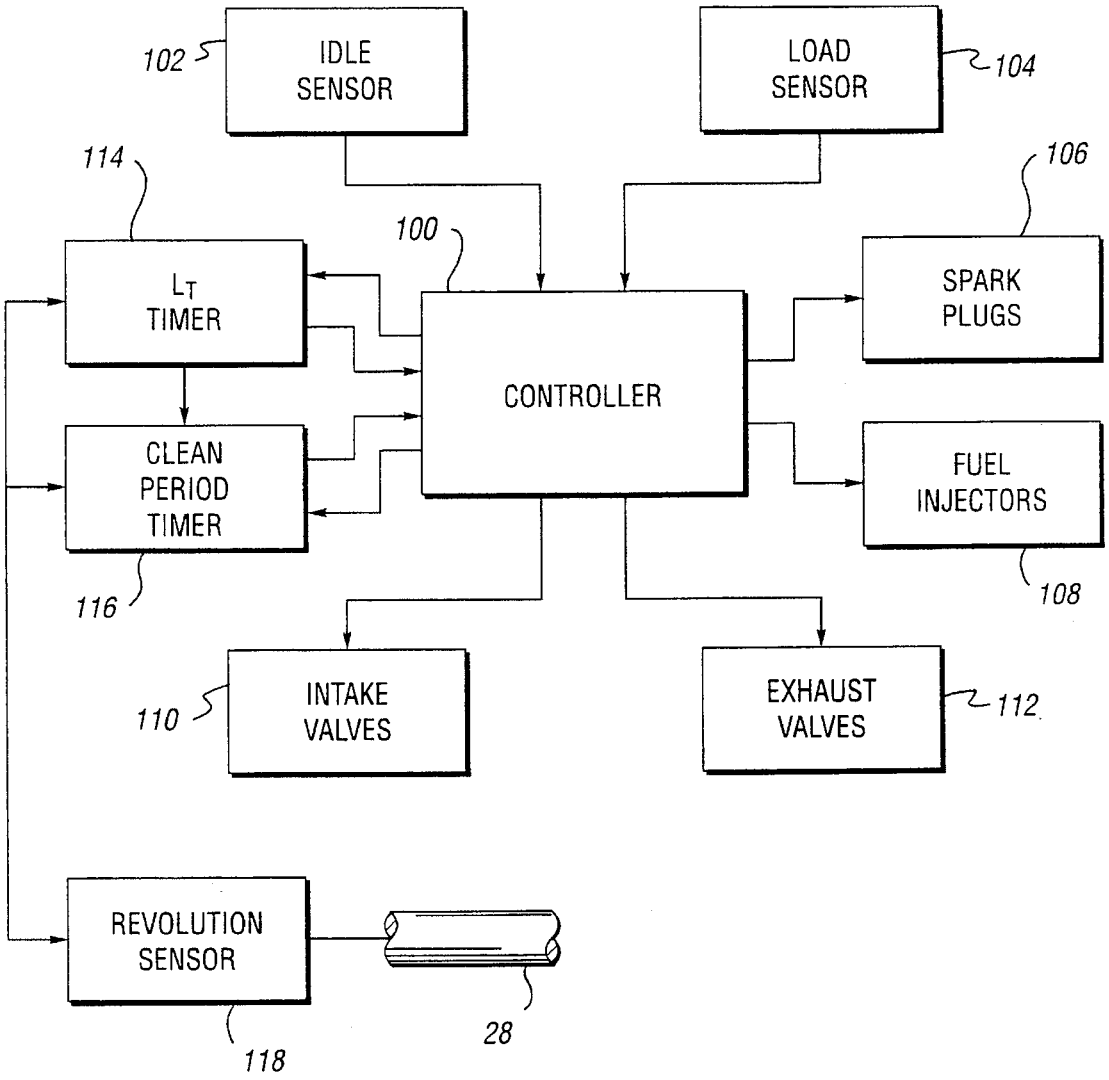
FIG. 3A is a block diagram of an alternate embodiment of the control shown in FIG. 3.

In the preferred embodiment, the disabled group of cylinders will remain disabled for a period of 15 to 30 minutes unless reactivated by the engine load signal exceeding the predetermined value K or other operational parameters of the variable displacement engine 10. Also, the clean period timer 116 will activate the disabled spark plug for a period of time, preferably between 0.5 and 1.0 second, selected to heat the previously disabled cylinders to an operating temperature and burn off the carbon and sludge from the spark plug. Preferably, the clean period timer enables the previously disabled cylinder for a predetermined number of revolutions of the variable displacement engines crankshaft 28. As shown in FIG. 3A, a revolution sensor 118 is response to a predetermined number of revolutions of the engine's crankshaft 28 to produce a signal indicative of the rotation of the crankshaft 28 preferably between 30,000 and 60,000 revolutions. In a like manner, the light load timer may also be responsive to a predetermined number of revolutions of the crankshaft to reactivate the disabled cylinders.

The primary advantage of the invention method is that periodic reactivation of the deactivated cylinders cleans the spark plugs when the variable displacement engine is operated for prolonged periods of time under light load conditions. The reduction in the frequency at which the deactivated are reactivated results in increased fuel economy and results in a much smoother operation of the engine during prolonged periods of light load operation such as may be encountered in expressway driving.

While the best mode for carrying out the invention has been described in detail, those familiar with the art to which this invention relates will recognize alternative designs and embodiments for practicing the invention as defined by the appended claims.

What is claimed is:

1. A method for maintaining clean spark plugs in a variable displacement, multiple cylinder engine, comprising:

generating a load signal in response to at least one of the operational parameter of the variable displacement engine;

generating a light load signal in response to said load signal being less than at least a first predetermined value;

terminating the fuel delivery and the energizing of the spark plugs for at least a first group of cylinders to disable said first group of cylinders in response to said light load signal;

detecting when said at least first group of cylinders has been disabled for a first period of time to re-enable said at least first group of cylinders for a second period of time much shorter than said first period of time, said second period of time selected to be sufficient to clean said spark plugs; and repeating said step of terminating in response to the expiration of said second period of time.

2. The method of claim 1 wherein each cylinder of said variable displacement engine has at least one intake valve and at least one exhaust valve, said step of termination to disable further comprises disabling at least one of said intake valves and exhaust valves to provide unthrottled operation of each cylinder in said at least one group of cylinders.

3. The method of claim 1 wherein said step of enabling comprises:

re-establishing fuel delivery to each cylinder of said at least one group of cylinders to provide a combustible air/fuel mixture to each cylinder of said at least one group of cylinders; and energizing said spark plugs in each re-enabled cylinder in timed relationship with the revolution of the engine to ignite said combustible air/fuel mixture.

4. The method of claim 1 wherein said first period of time is in the range from 15 to 30 minutes.

5. The method of claim 1 wherein said first period of time is the time required for the engine to make 30,000 to 60,000 revolutions.

6. The method of claim 1 wherein said second period of time is the time required for the engine to make 20 to 50 revolutions.

7. The method of claim 1 wherein said second period of time is between 0.5 and 1.0 seconds.

8. The method of claim 1 wherein said engine further comprises a throttle controlling the air delivery to the engine, said method further comprises the steps of:

generating an idle signal in response to said throttle being in an idle position; and inhibiting the disabling of said at least one group of cylinders in response to said idle signal.

9. The method of claim 1 wherein said at least one group of cylinders comprises at least two groups of cylinders and wherein said second group of cylinders is disabled when said light load signal is less than a second predetermined value less than said first predetermined value.

10. A control for maintaining clean spark plugs in a variable displacement engine having a plurality of cylinders comprising:

a load sensor responsive to the operational parameters of the engine to generate an engine load signal;

a first comparator for generating a light load signal in response to said engine load signal being less than a predetermined value;

means for terminating fuel delivery to and for terminating the energizing of the spark plugs to disable a first group of cylinders of the plurality of cylinders to disable said first group of cylinders in response to said light load signal to reduce the displacement of the variable displacement engine;

a first timer enabled by said light load signal to measure the time said first group of cylinders are disabled; and a second timer, enabled by said first timer after a first predetermined amount of time, to deactivate said means for terminating and re-enable said first group of cylinders for a second period of time much shorter than said first period of time, said second period of time selected to clean the spark plugs.

11. The control of claim 10 wherein each cylinder has at least one intake valve and at least one exhaust valve, said means for terminating comprises means for disabling at least one of said intake valves and exhaust valves to provide unthrottled operation of variable displacement engine.

12. The control of claim 10 wherein said first predetermined period of time ranges from 15 to 30 minutes.

13. The control of claim 10 wherein said second period of time is the time required for the engine to make a predetermined number of revolutions.

14. The control of claim 13 wherein said predetermined number of revolutions is from 20 to 50 revolutions.

15. The control of claim 10 wherein said variable displacement engine has a throttle displaceable from an idle position to a wide open throttle position, said control further comprises:

a throttle position sensor for generating an idle signal when the throttle is in the idle position; and means for inhibiting the disablement of said first group of cylinders when said load signal is less than said predetermined value.

16. The control of claim 10 wherein said variable displacement engine has 8 cylinders, said first group of cylinders comprises at least two cylinders.

17. The control of claim 16 wherein said first group of cylinders comprises 4 cylinders.

* * * * *